United States Patent [19]

Jesch

[11] Patent Number: 4,963,126

[45] Date of Patent: Oct. 16, 1990

[54] METHOD AND APPARATUS FOR FORMING CARTON BLANKS

[75] Inventor: Norman L. Jesch, Lafayette, Colo.

[73] Assignee: Adolph Coors Company, Golden, Colo.

[21] Appl. No.: 347,661

[22] Filed: May 5, 1989

[51] Int. Cl.[5] ..... B31B 1/16; B31B 1/25; B31B 1/12

[52] U.S. Cl. ..... 493/354; 493/342; 493/400; 493/472

[58] Field of Search ..... 493/342, 354, 355, 396, 493/400, 472

[56] References Cited

U.S. PATENT DOCUMENTS 2,425,041 8/1947 Luehrs ..... 493/354

3,137,218 6/1964 Elliott ..... 493/354

4,386,924 6/1983 Crawford et al. ..... 493/196

*Primary Examiner*—William E. Terrell

*Attorney, Agent, or Firm*—Klaas & Law

[57] ABSTRACT

Method and apparatus for preventing the curling of a composite material having a fluid permeable base and a fluid impermeable outer surface in a manufacturing operation wherein a continuous sheet of the composite material is moved in incremental amounts through a cutter-creaser apparatus to have carton blanks formed therein wherein the curling is prevented by forming a curtain of air under pressure to apply downwardly directed forces on the fluid impermeable surface during the incremental movement of the continuous sheet through the cutter-creaser apparatus and the forming of the carton blanks.

14 Claims, 3 Drawing Sheets

FIG. 7
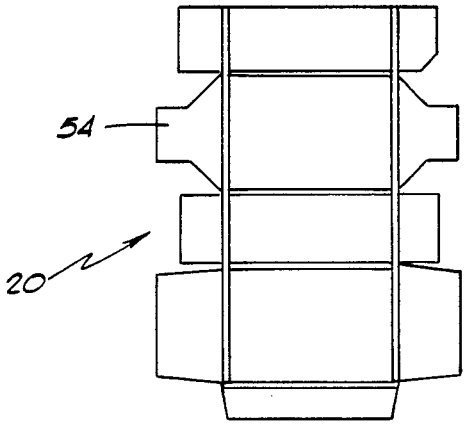
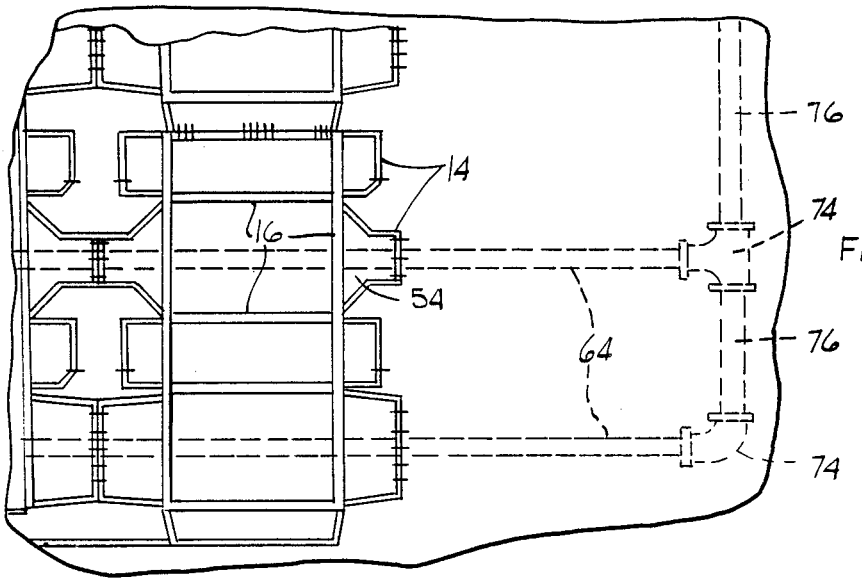
FIG. 8
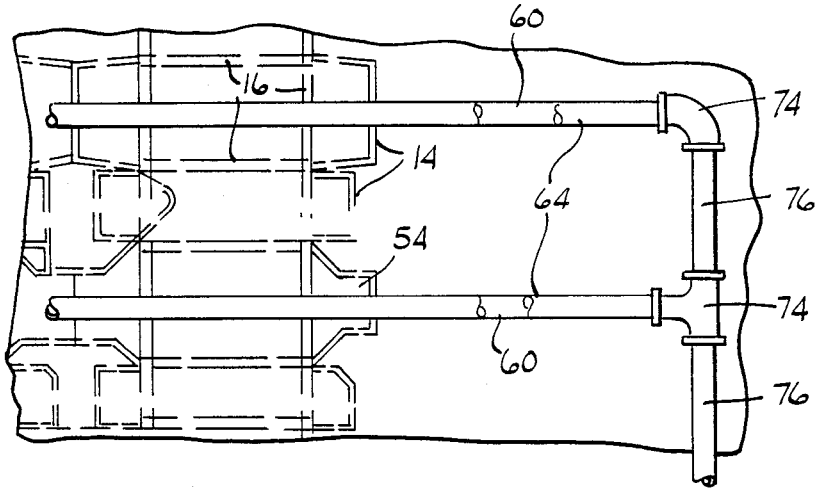
FIG. 9

METHOD AND APPARATUS FOR FORMING CARTON BLANKS

FIELD OF THE INVENTION

This invention relates generally to the making of carton blanks from a continuous sheet of material and more specifically the making of carton blanks from a continuous sheet of a composite material which has a paperboard base and a plastic film outer surface.

BACKGROUND OF THE INVENTION

A conventional method for forming carton blanks is to feed a continuous sheet of a paperboard material into a cutter-creaser apparatus in which a portion of the continuous sheet is cut and creased to form one or more carton blanks. In one commercial method, the continuous sheet comprises a composite material, of the type described in U.S. Pat. No. 4,254,173, which is incorporated herein by reference, which has a paperboard base and a plastic film outer surface. When this composite material is fed into the cutter-creaser apparatus, the paperboard base faces the lower platen and the plastic film faces the upper die. Since the plastic film outer surface will not allow moisture to escape from the paperboard base through it, there is a tendency for the composite material to curl up particularly in the cross-machine direction. This tendency to curl is increased after the cutting and creasing operations not only in the cross-machine direction but also for the portions of the flaps of the individual cartons that have been cut away on at least three sides thereof. Because of this, there is a tendency for portions of the composite material that have been cut and creased to hang up or get caught in portions of the upper die as the continuous sheet is moved in an incremental moving operation to its next location. This results in damaged carton blanks or, when serious enough, the stopping of operations to correct the difficulty. This is particularly true for relatively small cartons wherein the repeat length of each carton is less than about 12.5 inches and less than 8.5 inches in the cross-machine direction. The large number of cuts required to form a plurality of carton blanks of this size results in less overall stability of the portion of the continuous sheet being formed into cartons. Also, cartons of this size are formed from lower caliper material, such as less than 0.020 of an inch, which also results in less stability.

While the invention is described in relation to the composite material of the '173 patent, it includes other types of composite material having at least two layers, one of which is fluid containing and/or fluid permeable, such as moisture, and the other of which is a fluid impermeable layer such as a poly coated SBS (solid bleach sulfate) so as to have a fluid impermeable outer surface normally facing the upper die.

BRIEF DESCRIPTION OF THE INVENTION

This invention relates to the formation of carton blanks from a continuous sheet of a composite material having at least a fluid permeable base and a fluid impermeable outer surface and provides a curtain of air acting on at least a portion of the fluid impermeable outer surface particularly at about the same time it is being cut and creased and as it is being moved from the location between the upper die and the lower platen toward the stripper apparatus until it has been completely moved to a location clear from the actual cutting and creasing portions of the cutting-creasing apparatus.

In a preferred embodiment of the invention, a continuous sheet of the composite material of the type described in the U.S. Pat. No. '173 is fed into a conventional cutting-creasing apparatus so that the paperboard base faces the lower platen thereof and the plastic film outer surface faces the upper die thereof. The upper die comprises a rectangularly shaped block of material having lower and upper surfaces and a plurality of side surfaces and is mounted at a fixed location. A plurality of orifices are formed in the rectangularly shaped block of material and have openings in the lower surface thereof. The upper die is mounted at a fixed location while the lower platen is mounted opposite to the upper die and for reciprocal linear movement toward or away from the upper die. The continuous sheet of the composite material is moved in a conventional manner through the cutting-creasing apparatus in uniform successive incremental amounts. When the next succeeding incremental amount of the continuous sheet of composite material has been positioned between the actual cutting-creasing portions, the lower platen is moved toward the upper die so that the incremental amount of the composite material is located therebetween and sufficient pressure is applied to cut and crease the incremental amount of the composite material. During the incremental movement of the continuous sheet and during the actual cutting and creasing operations, air under pressure flows through the orifices in the rectangularly shaped block of material and moves downwardly into contact with the plastic film outer surface of portions of the continuous sheet. The air for the orifices is provided by a plurality of conduits mounted in channels in the upper surface of the rectangularly shaped block of material having openings therein in fluid communication with the orifices in the rectangularly shaped block of material. The conduits are connected to a supply of air which feeds the air to the conduits at desired pressures. The air flowing through the orifices is in quantities and pressures sufficient to form a curtain of air pushing downwardly against the plastic film outer surface to limit up curling thereof. The curtain of air applies a sufficient amount of forces on the plastic film outer surface so as to minimize any upwardly directed movement of portions of the plastic film outer surface. A plurality of openings are also located over at least the leading segment of the next succeeding incremental amount of the continuous sheet so that a curtain of air is pushing downwardly on such leading segment. A portion of the curtain of air also acts on the trailing portion of the next preceding incremental amount of the continuous sheet of the composite material which has had carton blanks formed therein. The air flow through the openings in the lower surface is continuous so that the curtain of air is acting on the succeeding incremental amounts of the continuous sheet of the composite material as they are being moved into and out of the position between the actual cutting and creasing portions of the lower platen and the upper die and while the cutting and creasing operation is being performed. Therefore, the continuous sheet of the composite material is in contact with the lower platen as it moves through the cutting and creasing apparatus.

BRIEF DESCRIPTION OF THE DRAWINGS

An illustrative and presently preferred embodiment of the invention is shown in the accompanying drawings in which:

FIG. 7 is a top plan view of the plastic film outer surface of one of the carton blanks of this invention;

FIG. 8 is an enlarged bottom plan view of a portion of FIG. 1 illustrating the cutting and creasing rules for one carton blank and portions of next adjacent carton blanks and FIG. 9 is a top plan view of FIG. 7.

DETAILED DESCRIPTION OF THE INVENTION

Figure 1:
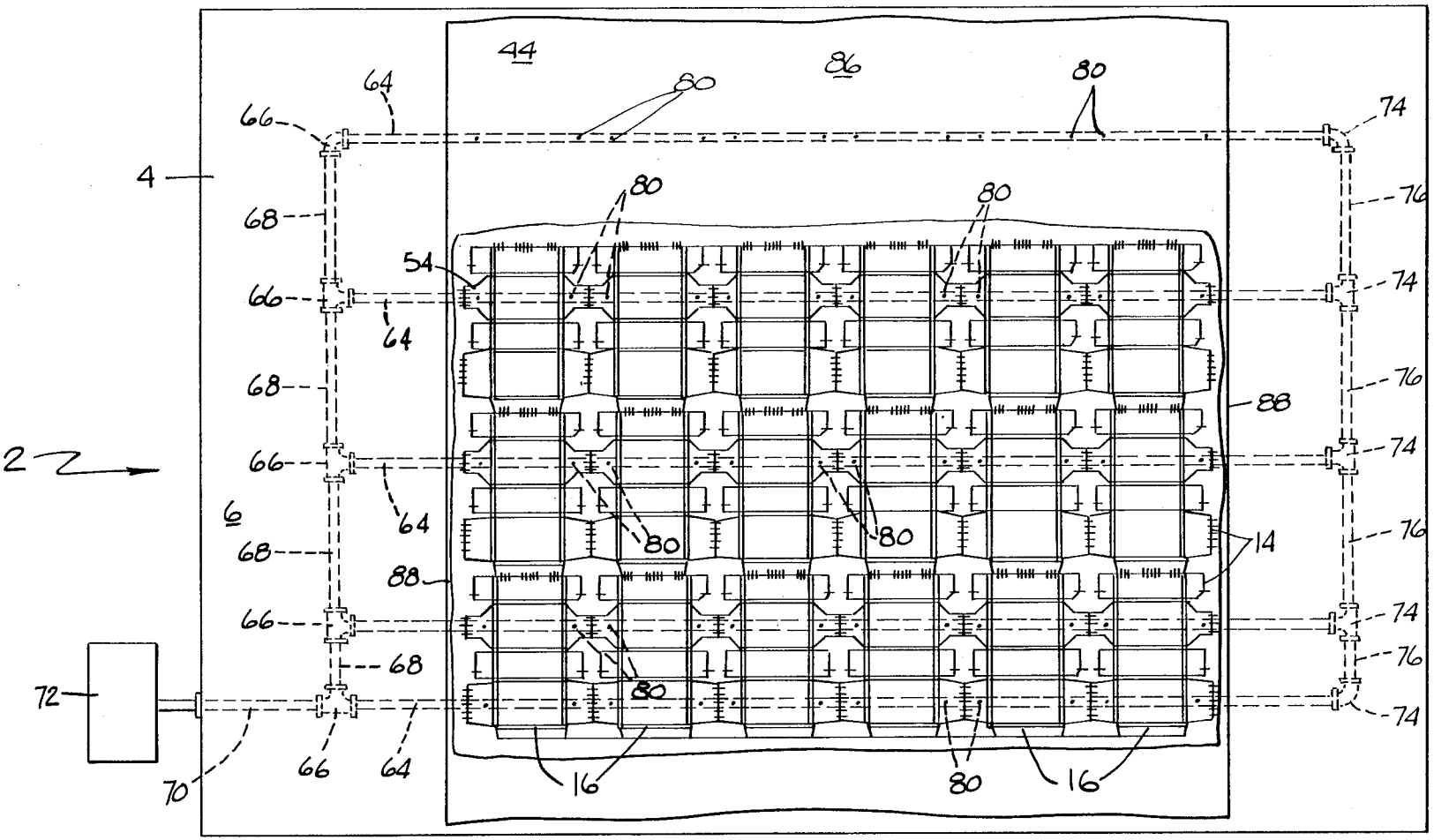
FIG. 1 is a bottom plan view of an upper die of the preferred embodiment of this invention.
Figure 3:
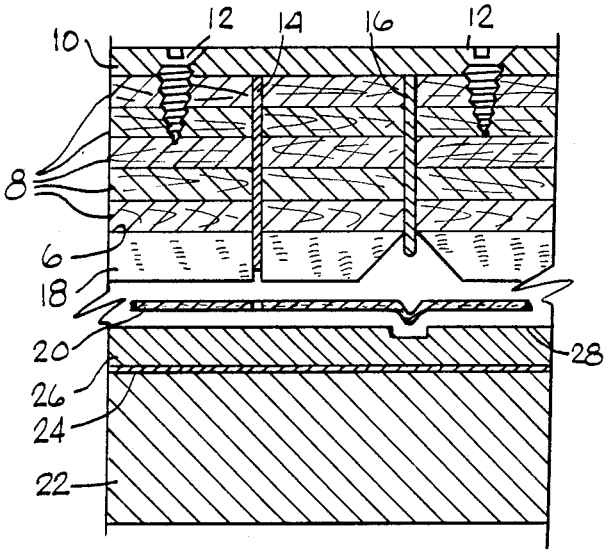
FIG. 3 (PRIOR ART)
FIG. 3 is a cross-sectional view of the upper die and lower platen of a conventional cutting-creasing apparatus.

The preferred embodiment of the invention is illustrated in FIGS. 1, 4 - 6, 8 and 9 and comprises an upper die 2 comprising a rectangularly shape block 4 of material. The rectangularly shaped block 4 may be formed in a conventional manner such as one Prior Art block illustrated in FIG. 3 which has a lower surface 6 and comprises five layers 8 of laminated die lumber and an upper platen 10 secured thereto by screws 12. A plurality of cutting rules 14 and creasing rules 16 are embedded in the rectangularly shaped block 4. A layer of a resilient material 18, such as rubber or rubberized cork, is secured to the lower surface 6 on each side of the cutting rules 14 and the creasing rules 16 and at other locations and functions to push the carton blank 20 off of the cutting rules 14 and creasing rules 16 after the carton blank 20 have been formed. One carton blank 20 is illustrated in FIG. 7 and the cutting rules 14 and the creasing rules 16 of FIG. 1 are positioned so as to form eighteen carton blanks 20. The numbers and positions of the carton blanks being formed can be varied as desired. In FIG. 3, there is also illustrated a conventional lower platen 22 having a spot sheet 24, a counter plate 26 and a creasing matrix 28.

Figure 2:
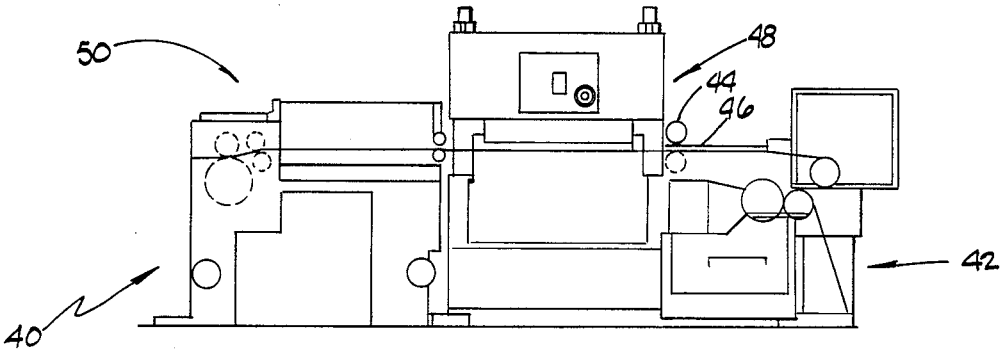
FIG. 2 (PRIOR ART)
FIG. 2 is a schematic illustration of a conventional process line for forming carton blanks.

In FIG. 2, there is a schematic illustration of a conventional process line 40 for forming carton blanks. The process line 40 comprises apparatus 42 for holding a roll of a composite material and have feed rolls 44 for incrementally feeding a continuous sheet 46 of the composite material to a cutter-creaser apparatus 48 which has a stationary upper die and a reciprocating lower platen which function to cut and crease successive incremental amounts of the continuous sheet into carton blanks. After the carton blanks have been cut and creased, they are pulled into a stripper apparatus 50 in a conventional manner.

Figure 4:
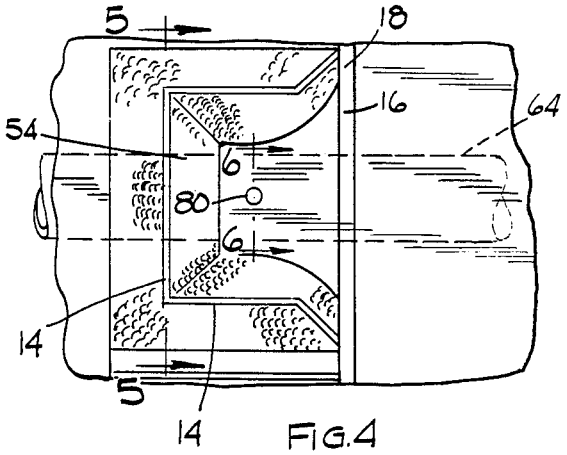
FIG. 4 is an enlarged top plan view of a portion of FIG. 1.
Figure 5:
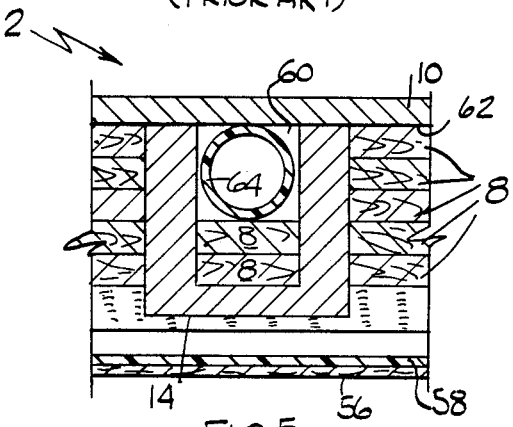
FIG. 5 is a cross-sectional view taken on the line of 5—5 of FIG. 4.
Figure 6:
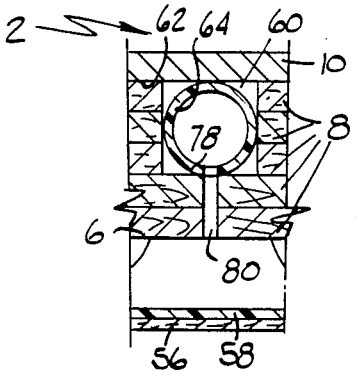
FIG. 6 is a cross-sectional view taken on the line 6—6 of FIG. 4.

The upper die 2 is illustrated in FIG. 1 wherein a plurality of cutting rules 14 and creasing rules 16 are embedded in the layers 8 while in FIGS. 4–6, there is illustrated one portion of the upper die 2 for forming a flap portion 54 of a carton blank 20. The cutting rule 14 is embedded in the layers 8 of the rectangularly shaped board 4. An incremental amount of the continuous sheet 44 comprising a paperboard base 56 and a plastic film outer surface 58 is adjacent to the layer of resilient material 18. A plurality of channels 60 are formed in the upper die 2 and extend downwardly from the upper surface 62. A plastic conduit 64 is positioned in each of the channels 60. The plastic conduits 64 are connected by fittings 66 and tubes 68 to a main supply conduit 70 all of which are positioned in channels similar to the channels 60. The main supply tube 70 is connected to a supply of air 72 under pressure of between about 30 to 60 psi and preferably about 40 psi for supplying air to the conduits 64. The conduits 64 are also illustrated as being interconnected by fittings 74 and conduits 76. However, if desired, the fittings 74 and conduits 76 could be omitted and the end of each conduit 64 could be sealed. As illustrated in FIG. 6, spaced apart openings 78 are formed in each conduit 64 and are aligned with spaced apart orifices 80, FIGS. 1 and 6, extending through layers 8 and opening through the lower surface 6. In construction, the orifices 80 are formed through the layers 8, the conduits 64 are positioned in the channels 60 and then the openings 78 are drilled in the conduits 64 using a drill bit passing through the orifices 80. The air under pressure exiting from the orifices 80 contacts the plastic film outer surface 58 and spreads out. There are sufficient number of orifices 80 so that the air issuing therefrom are in quantities and pressures sufficient to form a curtain of air applying forces over the entire surface of at least a major portion of the plastic film outer surface 58 under the rectangularly shaped block 4. At least one conduit 64 is in a channel 60 which is opposite to a leading segment 86 of the next succeeding incremental amount of the continuous sheet 44 and has a plurality of orifices 80 to direct air under pressure onto the plastic film outer surface 58 thereof.

In operation, the continuous sheet 44 is fed in incremental amounts under the upper die 2 so that one incremental amount thereof is beneath and spaced from the layer of resilient material 18 surrounding the cutting rules 14 and the creasing rules 16 with the plastic film outer surface 58 facing the layer of resilient material 18. Air under pressure of between about 30 and 60 psi and preferably about 30 psi is continuously being emitted from the orifices 80 each of which has a diameter of between about 0.020 and 0.040 of an inch and preferably about 0.03125 of an inch so that it is sufficient to form a curtain of air that moves downwardly onto the plastic film outer surface 58 to apply forces thereto during the movement of the continuous sheet 44 and when it is stopped under the upper die 2. The lower platen is moved upwardly and the carton blanks 20 are formed. The lower platen is moved downwardly and the formed carton blanks 20 are pushed off the upper die by the layer of resilient material 18. The curtain of air provides downwardly directed pressure forces on the plastic film outer surface 58 so as to prevent any substantial curling of that incremental amount of the continuous sheet or of any portions of the carton blank. Therefore, there is nothing to catch in any portion of the upper die as the continuous sheet is incrementally moved to place the next succeeding incremental amount of the continuous sheet between the upper die and the lower platen. After the carton blanks have been formed, they are pulled into the stripper apparatus 50 in a conventional manner.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Method for cutting carton blanks from a continuous sheet of a composite material having at least a fluid permeable base and a fluid impermeable outer surface comprising:

mounting an upper die at a fixed position having rule means on the front surface thereof for defining cutting lines and score lines;

mounting a lower platen for reciprocal movement toward or away from said upper die and having an upper surface for cooperating with said upper die and lower platen to form cut and score lines;

feeding a continuous sheet of a composite material comprising said fluid permeable base facing said lower platen and said fluid impermeable outer surface facing said upper die into position between said upper die and said lower die by moving said continuous sheet in successive incremental amounts to locate each succeeding incremental amount between said lower platen and said upper die;

moving said lower platen into contact with said fluid permeable base and applying pressure thereto to move said fluid permeable base toward said upper die so as to form cut lines and score lines in said composite material base defining a plurality of carton blanks;

applying downwardly directed forces onto said fluid impermeable outer surface to minimize any upwardly directed movement of portions of said fluid impermeable outer surface;

moving said lower platen away from said upper die while continuing to apply said downwardly directed forces onto said fluid impermeable outer surface;

separating said fluid impermeable outer surface from said upper die while continuing to apply said downwardly directed forces onto said fluid impermeable outer surface;

moving said continuous sheet in the next incremental amount while continuing to apply said downwardly directed forces; and stripping said carton blanks from said continuous sheet.

2. The invention as in claim 1 wherein said application of said downwardly directed forces comprises:

blowing air under pressure through a plurality of spaced apart orifices formed in said upper die downwardly onto said fluid impermeable outer surface.

3. The invention as in claim 2 and further comprising:

forming at least one channel in the back surface of said upper die;

mounting at least one air conduit in said at least one channel;

forming a plurality of openings in said at least one air conduit with each of said openings in said at least one air conduit being aligned with one of said orifices in said upper die; and connecting said at least one air conduit to a supply of air under pressure so that air under pressure issues from said orifices and moves downwardly into contact with said fluid impermeable outer surface.

4. The invention as in claim 2 and further comprising:

forming a plurality of channels in the back surface of said upper die;

mounting at least one air conduit in each of said channels;

forming a plurality of openings in each of said air conduits with each of said openings being aligned with one of said orifices in said upper die;

connecting each of said plurality of air conduits to a common air inlet; and connecting said common air inlet to a supply of air under pressure so that air under pressure issues from said orifices and moves downwardly into contact with said fluid impermeable outer surface.

5. The invention as in claim 4 and further comprising:

moving said air through said orifices in quantities and at pressures sufficient to form a curtain of air pushing downwardly against said fluid impermeable outer surface.

6. The invention as in claim 5 and further comprising:

locating at least one cf said air conduits to form a portion of said air curtain over a leading segment of the next succeeding incremental amount of said continuous sheet.

7. Apparatus for cutting and creasing carton blanks from a continuous sheet of a composite material having at least a fluid permeable base and a fluid impermeable outer surface comprising:

an upper die comprising a rectangularly shaped block of material having lower and upper surfaces and mounted at a fixed location;

a lower platen mounted opposite to said upper die and for reciprocal movement toward or away from said upper die;

feeding means for feeding said continuous sheet of a composite material in incremental amounts so as to position each succeeding incremental amount of said continuous sheet between said lower platen and said upper die;

cutting rules and creasing rules mounted in said rectangularly shaped block so that portions thereof extend downwardly from said lower surface and are adapted to contact said fluid impermeable outer surface to cooperate with said lower platen in forming cuts and grooves in said composite material;

force applying means for applying a downwardly directed force at least on the portion of said fluid impermeable outer surface under said upper die to minimize any upwardly directed movement of portions of said fluid impermeable outer surface at least during the feeding of said incremental amount of said composite material into position between said lower platen and said upper die and during the movement thereof out of said position; and wherein said force applying means comprise:

said block of material having a plurality of spaced apart orifices formed therein and having openings in said lower surface;

a supply of air under pressure; and connecting means for connecting said plurality of orifices to said supply of air so that air under pressure issues from said orifices and moves downwardly into contact with said fluid impermeable outer surface.

8. The invention as in claim 7 wherein said connecting means comprises:

said upper surface of said upper die having at least one downwardly extending channel formed therein;

at least one conduit positioned in said at least one channel; and said at least one conduit having a plurality of openings formed therein with each of said openings being aligned with one of said orifices.

9. The invention as in claim 7 and further comprising:

said upper surface of said upper die having a plurality of downwardly extending channels formed therein;

at least one conduit mounted in each of said channels;

each of said conduits having a plurality of openings formed therein with each of said openings being aligned with one of said orifices in said upper die;

an air inlet connected to a supply of air under pressures; and connecting means for connecting each of said conduits to said air inlet so that air under pressure issues from each of said orifices and moves downwardly into contact with said fluid impermeable outer surface.

10. The invention as in claim 9 wherein:

each of said orifices and said openings in said conduits having circular transverse cross-sectional configurations having a diameter between about 0.020 and 0.040 of an inch; and said supply of air has a pressure of between about 30 and 60 psi.

11. The invention as in claim 9 wherein:

each of said orifices and said openings in said conduits having circular transverse cross-sectional configurations having a diameter of about 0.03125 of an inch; and said supply of air has a pressure of about 40 psi.

12. The invention as in claim 9 wherein:

said air issues from said orifices in quantities and at pressures sufficient to form a curtain of air pushing downwardly against said fluid impermeable outer surface.

13. The invention as in claim 9 and further comprising:

at least one of said conduits being located opposite to at least a leading segment of the next succeeding incremental amount of said continuous sheet so that air issuing from said orifices will move downwardly into contact with said fluid impermeable outer surface of said at least a leading segment.

14. The invention as in claim 14 wherein:

said air issues from said orifices in quantities and at pressures sufficient to form a curtain of air pushing downwardly against said fluid impermeable outer surface of said incremental amount under said upper die and said at least a leading segment.

* * * * *